US005803298A

United States Patent [19]

Hausmann

[11] Patent Number: 5,803,298

[45] Date of Patent: Sep. 8, 1998

[54] CONTAINER AND CONTAINER LID ASSEMBLY WITH RETAINING RING

[76] Inventor: Donald H. Hausmann, 827 Harvard, Houston, Tex. 77007

[21] Appl. No.: 852,916

[22] Filed: May 8, 1997

Related U.S. Application Data

[63] Continuation of Ser. No. 651,768, May 22, 1996, abandoned, which is a continuation of Ser. No. 370,740, Jan. 10, 1995, abandoned.

[51] Int. Cl.[6] ..... B65D 45/32

[52] U.S. Cl. ..... 220/319; 220/322; 220/700

[58] Field of Search ..... 220/319, 322, 220/694, 699, 700, 701, 780; 215/274

[56] References Cited

U.S. PATENT DOCUMENTS

| | | | |
|---|---|---|---|
| 1,593,633 | 7/1926 | Johnson . | |
| 1,948,920 | 2/1934 | Johnson . | |
| 2,893,456 | 7/1959 | Wallace | 215/274 |
| 3,298,561 | 1/1967 | McConnie . | |
| 3,469,735 | 9/1969 | Burt . | |
| 3,815,777 | 6/1974 | Churan . | |
| 3,913,785 | 10/1975 | Pattershall . | |
| 4,111,330 | 9/1978 | Jordan . | |
| 4,165,018 | 8/1979 | Giggard . | |
| 4,595,111 | 6/1986 | Gould . | |
| 4,625,890 | 12/1986 | Galer . | |
| 4,728,003 | 3/1988 | Davey | 220/319 |
| 4,932,554 | 6/1990 | Smith et al. | 220/319 |
| 4,969,570 | 11/1990 | Harvey, Sr. . | |
| 5,161,689 | 11/1992 | Balson | 220/700 X |
| 5,174,464 | 12/1992 | Walt | 220/319 X |
| 5,193,705 | 3/1993 | McCallum et al. . | |
| 5,261,551 | 11/1993 | Watt . | |
| 5,381,918 | 1/1995 | Dahl . | |
| 5,421,473 | 6/1995 | McCrossen | 220/319 |
| 5,582,318 | 12/1996 | Dietrich | 220/319 |

FOREIGN PATENT DOCUMENTS

| | | | |
|---|---|---|---|
| 552834 | 2/1958 | Canada . | |
| 535383 | 4/1993 | European Pat. Off. | 220/319 |
| 1362620 | 4/1964 | France . | |

*Primary Examiner*—Allan N. Shoap
*Assistant Examiner*—Robin A. Hylton
*Attorney, Agent, or Firm*—James L. Jackson

[57] ABSTRACT

A lid retainer is provided for a "paint can" type container having a lid that is secured to the top wall thereof by multi-friction fit. The lid retainer is composed of a high tensile strength, impact resistant polymer material having limited flexible and defines a circular body section with a circular lid retainer flange and a circular locking flange projection downwardly from respective inner and outer radial extents of the circular body section. The locking flange has a radially inwardly extending locking projection having a downwardly and radially inwardly facing can surface disposed for camming engagement with the circular bead that interconnects the side and top walls of the container and induces yielding of the retainer flange as the locking projection passes over the circular bead. The retainer flange is positioned for circular contact with the central panel of the lid at a location radially inwardly of the friction seal for the lid of the container and radially inwardly of the central opening of the top wall, thereby providing sufficient mechanical advantage to effectively resist pressure induced unseating of the lid from the top wall.

14 Claims, 1 Drawing Sheet

CONTAINER AND CONTAINER LID ASSEMBLY WITH RETAINING RING

This application is a continuation of application Ser. No. 08/651,768 filed on May 22, 1996 now abandoned, which is a continuation of application Ser. No. 08/370,740, now abandoned filed on Jan. 10, 1995.

FIELD OF THE INVENTION

This invention relates generally to containers such as cylindrical metal containers having large upper openings and having a circular closure lid which is frictionally retained in assembly therewith. More specifically, the present invention concerns a retainer ring for container closure lids which is placed in assembly with the container and lid and which serves to resist to the tendency of the lid to become unseated from sealed assembly with the container by the force of differential pressure being higher within the container than the pressure of the environment externally of the container.

BACKGROUND OF THE INVENTION

Metal containers with friction type closures are utilized for shipment and handling of many materials including potentially hazardous material such as paint and certain liquid chemical materials. In many cases the containers are shipped or handled in such manner that a significant differential pressure will exist between the pressure internally of the container and the pressure of the environment externally of the container. This pressure differential can be developed if the ambient pressure externally of the container is significantly reduced, such as in the case of air travel where the cargo compartment of an airplane may be depressurized or may be at a pressure that is less than at atmospheric pressure. In some cases vaporization of the contained material can develop an internal pressure within the container that significantly exceeds atmospheric pressure. According to present United Nations regulations metal containers in various differing sizes, commonly known as "paint containers" having friction lids or closures designed for multi-friction sealed fit with the container must have the capability for withstanding an internal pressure of 14.5 psi (100 KPa) for a period of 5 minutes. This regulation has been necessitated because of the tendency of such multi-friction fit containers to leak during shipment as the result of the friction lids thereof becoming unseated by the force which is developed against the inside surfaces of the container and lid by pressure differential. It is desirable therefore to provide means for resisting the unseating force on frictionally retained container lids so that the containers will be capable of remaining sealed even when internal container pressure significantly exceeds external pressure and thus complying with the regulations of the United Nations Committee on the transportation of dangerous goods and being suitable for use in the transportation of many liquid materials.

For the reason that containers having frictionally retained lids, such as one gallon paint containers for example, are of low cost construction, it is highly desirable to utilize such containers for the handling and transportation of a wide range of liquid materials. Further, to maintain the low cost nature of the containers, and yet ensure compliance with United Nations regulations as mentioned above, it is desirable to provide retainer means for securing the container lids in frictionally retained, sealed relation with the containers even when they are subjected to the internal test pressure mentioned above. It is also desirable that the lid retainers be of simple and low cost design and construction and yet have the capability for adequate retention of multi-friction sealed lids in sealed with relation with the containers. It is also desirable that the lid retainers be capable of reuse if desired.

Though the friction engaging surfaces of the multi friction fit containers will vary significantly from manufacturer to manufacturer, the central panel portion of virtually all friction fit lids are the same. Also, the external configuration and dimension of the friction fit lids of differing manufacturers are fairly consistent. Consequently, lid lock rings that engage within the outer peripheral recess of container lids, such as is exemplified by U.S. Pat. No. 5,193,705 of McCallum, et al. are typically restricted to the containers of specific manufacturers or containers of specific design or lid configuration. Because these lid lock rings are not generic to a wide variety of container and container lid configurations, a number of different lid lock rings may be required to adequately secure the lids of containers of differing lid design even when the containers are of the same volumetric dimension. This problem can require a shipping organization to maintain a significant inventory of differing container lock rings to adequately provide for the variety of multi-friction fit containers that may be encountered. It is desirable therefore to provide a container lid retainer ring which is capable of bridging the ridges and grooves that are present at the outer peripheral portions of most container lids and engaging the central panel portion of the lids. This feature enables the lid retainer ring to be generic to a wide range of differing friction lids and thus significantly minimizes the inventory requirements of organizations that specialize in the shipping and handling of liquid products in containers.

SUMMARY OF THE INVENTION

It is a principal feature of the present invention to provide a novel retainer ring for securing the friction lids of metal containers in such manner that the containers are capable of withstanding an internal pressure of 14.5 psi (100 KPa) for a period of 5 minutes and thus qualify for use in shipment of hazardous materials in international commerce.

It is also a feature of the present invention to provide a novel retainer ring for securing the friction lids of container which establishes locking relation with the outer predetermined peripheral bead of the container and engages the top wall of the container lid in a manner to effectively restrain pressure induced unseating force thereof.

It is even a further feature of the present invention to provide a novel retainer ring for the multi-friction fit lids of containers and which establishes retaining engagement with the container lid at a location radially inwardly of the circular rim defining the opening of the container and thereby providing significant mechanical advantage in resistance to the tendency of the container lid to become unseated by internal pressure.

It is an even further feature of this invention to provide a novel retainer ring for multi-friction fit container lids which is capable of defining inner and outer circular radial areas of contact with a container lid as the lid moves a predetermined amount during pressure induced unseating to thereby enhance the force resisting mechanical advantage of the lid retainer ring.

It is also a feature of this invention to provide a lid retainer ring that bridges the ridges and grooves of the outer peripheral portion of a container lid and establishes retaining engagement with the central panel of the container lid and thus is generic to a wide variety of container lid designs and minimizes the inventory requirements of users.

Briefly, the various objects and features of the present invention are realized through the provision of a retainer ring which is capable of fitting in locking relation about the upper outer peripheral portion of a cylindrical container and which establishes circular engagement with the friction lid of the container at a location radially inwardly of the circular container rim establishing the access opening of the container. By engaging the container lid at this radially inward location the container lid retainer establishes significant mechanical advantage to effectively resist the forces tending to unseat the container lid by internal pressure which significantly exceeds the pressure of the environment externally of the container. Since the lid retainer ring bridges the ridges and grooves of the container lid and engages the central panel the lid retainer ring is generic to a number of differing container lid designs and configurations.

In particular, the container lid locking ring is composed any one of a number of suitable high tensile strength, input resistant polymer materials, such as polyethylene and high density polyethylene, for example and is adapted to multi friction fit lid containers such as typical "paint" containers having a cylindrical side wall and circular bottom and having a top wall that is double seamed to the top edge of the container side wall by a rolled peripheral bead. The top wall of the container defines an upwardly facing circular friction groove having inner and outer circular seal walls which receive a downwardly projecting circular friction rim of a container lid in sealed relation therewith. The top wall further defines a rolled inner rim defining the circular access opening of the container and the container lid defines a downwardly facing circular recess forming a circular shoulder which engages the inner container rim and limits lid movement at a fully seated position. The container lid may further define an upwardly facing circular depression located radially inwardly of the downwardly facing recess and thus being located radially inwardly of the circular rolled inner rim of the top wall when the container lid is in pressed fitting sealed engagement with respect to the top wall.

The circular body of the lid retainer also defines an intermediate restraint surface which is engaged by the outer periphery of the lid if the lid should be moved by pressure induced force to a sealed but partially unseated position. This intermediate restraint contact of the retainer ring with the lid is in addition to the restraining contact of the retainer flange with the lid and thus adds to the mechanical advantage of the retainer. Thus as the pressure induced unseating force increases the force restraining capability of the retainer ring also increases.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which.

In the drawings

DETAILED DESCRIPTION OF PREFERRED EMBODIMENT

Figure 1:
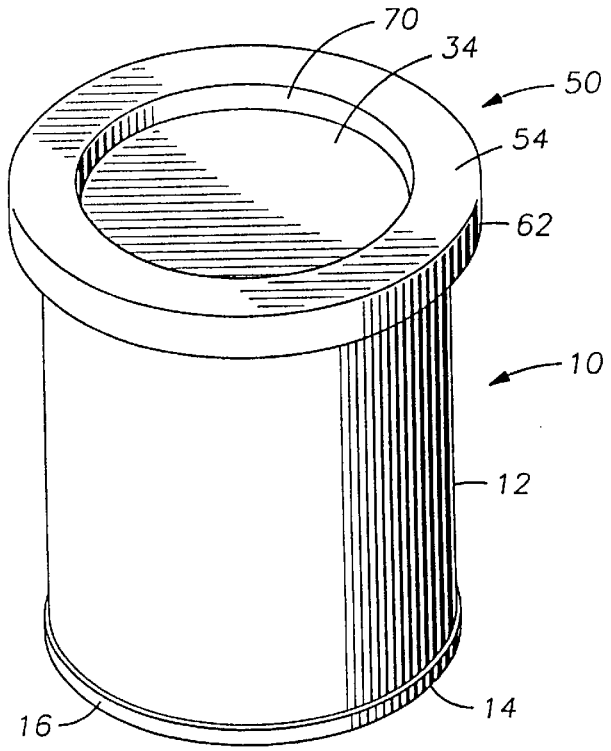
FIG. 1 is an isometric illustration of a conventional one gallon paint type container having a lid retainer ring constructed in accordance with the present invention being assembled to the top of the container in lid restraining relation therewith.

Referring now to the drawings and first to FIG. 1, a conventional "paint" type container is shown generally at 10 which is defined by a cylindrical side wall 12 to which is connected a bottom wall 14 by means of a conventional double rolled bead 16. At the upper end of the container 10 a top wall 18 is connected to the upper end of the cylindrical wall 12 by means of a like conventional double rolled bead 20 which defines a downwardly facing circular shoulder 22. Radially inwardly of the circular double rolled bead 20 the top wall 18 defines a generally U-shaped upwardly opening receptacle 24 having radially inner and outer circular friction sealing walls 26 and 28, respectively. The inner circular friction sealing wall 26 defines an inwardly rolled upstanding circular or rim lip 30. This circular rim also defines the central opening of the top wall 18 and, in the case of paint cans, defines a circular rolled wiping edge which defines a circular wiping surface for control of the quantity of paint in paint brushes. Containers of this type having multi friction fit lids are used in to handle, store and ship many different types of products including liquid and solid products.

A container of the type shown at 10 is provided with a multi-friction lid as shown generally at 32 which is retained in frictionally sealed assembly with the top wall 18 of the container. This sealed assembly is of sufficient integrity to prevent leakage of the contents of the container even when the container is placed on its side or inverted. The seal is also of sufficient integrity to contain internal pressure to a limited extent. In accordance with the regulations of the United States government and the United Nations committee on the transportation of dangerous goods a multi-friction fit paint container of the character shown in FIG. 1 must withstand an internal pressure of 14.5 psi (100 KPa) for a period of 5 minutes. Thus, should internal pressure within the container increase, such as due to the heating of its contents or when the container is subjected to significant pressure differential, which can occur when the container is transported by air freight, it is desirable to ensure that the lid of the container maintain a metal to metal multi-surface frictional fit and maintain a positive seal with the top wall of the container. This sealed frictional retention of the lid to the container ensures that the contents do not become spilled or vented to the surrounding local atmosphere in the event the internal pressure of the container should become significantly greater than atmospheric pressure. The multi-sealed friction lid 32 is of integral construction defining a central closure panel 34 and terminating at a rolled outer rim 36. The radially outer portion of the lid 32 defines a downwardly depending circular section 38 of generally U-shaped cross-sectional configuration which defines inner and outer friction seal walls 40 and 42 which are disposed in essentially parallel relation with one another. These inner and outer seal walls are positioned for respective frictional sealing contact with the inner and outer circular walls 26 and 28 of the U-shaped projection 24 of the top wall 18. This feature enables the lid to be pressed into sealed engagement with the top wall 18 of the container by forcing the downwardly projecting U-shaped friction sealing section of the lid into the circular friction sealing groove or receptacle 24 of the top wall.

Figure 2:
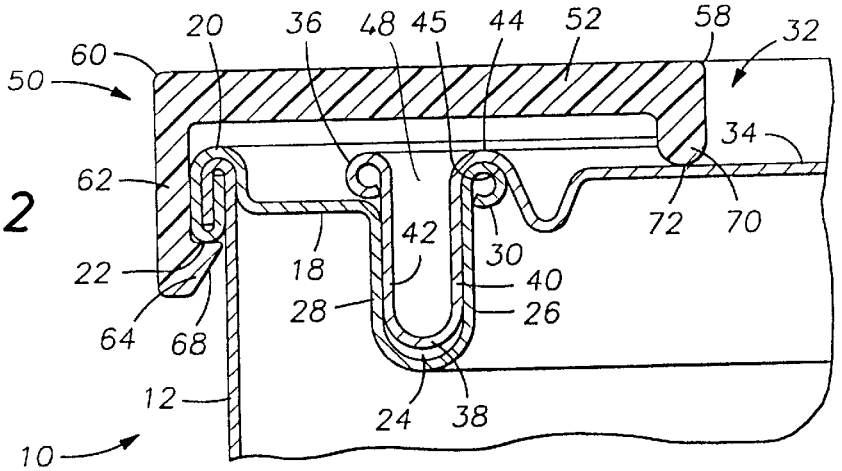
FIG. 2 is a fragmentary sectional view of the container of FIG. 1 showing the construction thereof and the relation of the multi-friction fit lid in fully seated relation therewith and further showing the normal position of the lid retainer ring in assembly therewith.
Figure 3:
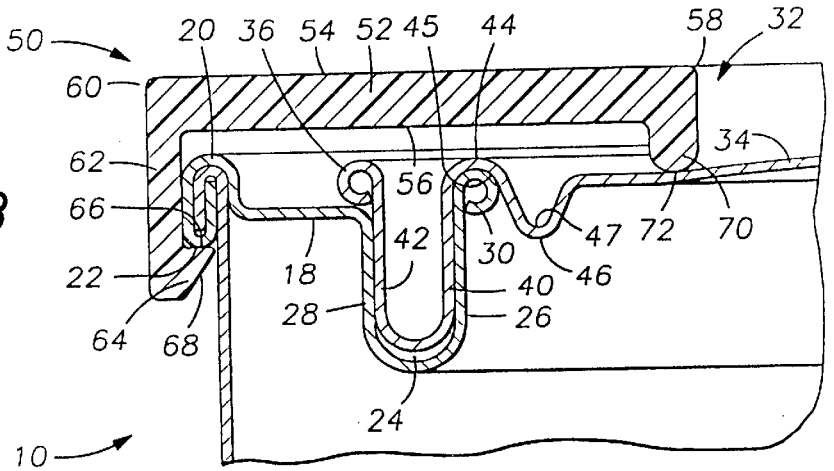
FIG. 3 is a fragmentary sectional view similar to that of FIG. 2 and showing the container lid deformation that can occur due to internal pressure and further showing the position of the lid locking ring for retaining the lid in sealed assembly with the container.

Immediately inwardly of the inner friction sealing wall 40 the lid 32 defines a reverse curved section 44 which serves as a circular downwardly facing shoulder which seats against and is supported by the upper surface of the circular bead 30. The downwardly facing shoulder defined by the curved section 44 is of a configuration and dimension to receive the upstanding circular rim 30 of the top wall in closely fitted relation therein. Thus, the upstanding circular rim 30 limits downward seating movement of the lid 32 relative to the top wall 18 so that the fully seated relationship of the lid to the top wall is shown in FIG. 2. The circular rim also establishes metal-to-metal friction sealing engagement with a circular wall surface 45 defined by the downwardly facing shoulder area 44 of the lid. Immediately inwardly of the reverse curved section 44 of the lid, the lid may define a circular depression 46 defining an upwardly facing circular groove 48. Radially inwardly of the curved shoulder section 44 and circular depression 46 the lid defines a central wall 34 which may project upwardly as shown in FIG. 3 or which may extend in substantially planar or only slightly curved relation from the circular groove 48 inwardly as shown in FIG. 3.

As pressure within the container 10 exceeds the atmospheric pressure externally of the container to an extent developing an unseating force exceeding the friction retention force of the lid the internal pressure will tend to move the lid upwardly and unseat the sealing walls 40 and 42 of the lid from the corresponding sealing walls 26 and 28 of the top wall 18. If the lid is not restrained in any manner the lid can be moved upwardly or outwardly from the container opening to the extent that the circular radial metal-to-metal seals of the walls 26, 28, 40 and 42 will be lost. Either the lid 32 will become completely separated from the container whereby its contents can spill or the seal of the lid with the container will be degraded to the extent that the contents of the container will leak or be vented to the external atmosphere by the pressure differential. If the contents of the container are hazardous in any manner the external atmosphere can be contaminated by the liquid or vapor contents of the container.

In accordance with the teachings of the present invention, to provide container of this type with the capability of meeting specific pressure containing regulations for multi-friction fit containers, i.e. 14.5 psi (100 KPa) for a period of 5 minutes, a lid retainer or lock ring shown generally at 50 is provided which establishes an interlocking relationship with the container and establishes a force restraining contact the lid for the purpose of restraining the lid from being unseated at pressure differentials below that designated by governmentally established pressure regulations. As shown in FIGS. 1–3 and by way of cross-section in FIGS. 2 and 3 the retainer ring 50 defines a circular, generally planar body 52 composed of any one of a number of suitable substantially rigid polymer materials having a degree of limited flexibility. Suitable polymer materials for this purpose may be polyethylene, high density polyethylene, or any other high tensile strength, impact resistant plastics material. Preferably the retainer ring 50 is of integral construction and it may be molded of polymer material or machined from polymer stock depending upon the needs and desires of the user. The circular ring-like retainer element 50, as mentioned above, defines a circular substantially planar body 52 having a substantially planar upper wall 54 and a substantially planar bottom wall 56, the top and bottom walls 54 and 56 being preferably of substantially parallel relation. It should be borne in mind, however that the top and bottom walls need not be of parallel relation if other retainer ring design is considered more appropriate. The top wall surface defines radially inner and outer generally concentric circular extents 58 and 60 as shown in FIG. 3.

For locking of the retainer ring 50 to the container 10 an external depending locking flange 62, formed integrally with the circular body section 52, projects downwardly from the radially outer extent 60 of the circular body 52 and defines a locking flange for the retainer ring. The locking flange is provided at its lower extent with an inwardly projecting locking section 64 having an upwardly facing locking shoulder 66 which is disposed for locking engagement with the downwardly facing circular shoulder 22 of the double rolled bead 20 of the container. The radially inwardly extending locking projection 64 also defines a circular angulated cam surface 68 which faces downwardly and radially inwardly and which contacts the upper surface of the rolled bead 20 as the retainer ring is being forced into assembly with the container. Application of downward force on the retainer ring causes mechanical reaction between the cam surface 68 and the upper circular portion of the rolled bead 20 thereby inducing a radially outwardly directed force on the locking flange 62. Because of the slight degree of resilience of the material from the which the retainer ring is formed this radially induced force will cause the locking flange to yield radially outwardly thereby allowing the locking projection 64 to move downwardly past the rolled bead 20. After the locking projection 64 has cleared the downward extent of the rolled bead, the inherent memory of the material of the retainer ring will cause the locking projection to snap radially inwardly, positioning the upwardly facing circular locking shoulder 66 in seated engagement with the downwardly facing circular shoulder 22 of the rolled bead. Thus by simple application of downward force the retainer ring will be snapped into firmly seated, locking engagement with the container 10.

In order to secure the lid in seated relation with the top wall of the container and to restrain unseating of the lid by pressure differential, the retainer ring 54 is provided with a circular retainer flange 70 which is preferably formed integrally with the circular body 52 and which is disposed for retaining engagement with the lid 32 at a location radially inwardly of the ridges and grooves of the lid and the circular rolled rim 30 of the top wall 18. The retainer flange 70 defines a lower circular surface 72 which, in fully seated relationship with the container and lid, establishes contact with the central wall panel 34 of the lid. Positioning of the contact of the circular retainer flange radially inwardly of the rolled circular edge 30 of the top wall provides the retainer ring with an extensive lever arm which provides for enhanced pressure containing retention of the lid as compared to other types of container lid retainers. As the pressure differential between the internal pressure of the container and the pressure of the external atmospheric environment becomes greater unseating force on the container lid 34 can tend to urge the lid in such manner as to unseat the circular metal-to-metal seals of the walls 20, 26, 40 and 42 of the top wall and lid. As this lid unseating force occurs the inherent structural integrity of the circular retainer ring and in particular the force retention capability provided by the extensive lever arm of the retainer flange due to its circular engagement with the central panel 34 of the lid will restrain the unseating force to a significant degree. By establishing restraining engagement of the retainer flange with the lid radially inwardly of the rolled circular flange 30 of the top wall the unseating force of the lid will be transferred through the retainer flange 70 and the substantially rigid retainer body 52 to the locking flange 62 and its locking projection. Thus, the unseating force of the lid caused by pressure differential is transferred from the lid by the retainer ring to the downwardly facing shoulder 22 of the rolled container/top wall bead 20 thus essentially bridging the radially outer sealing portions of the lid and top wall. As the pressure induced unseating force becomes greater the retainer ring, being essentially rigid, will simply increase the force transferring characteristics from the lid directly to the downwardly facing shoulder 22 of the container. This force transferring characteristic overcomes the unseating forces tending to unseat the sealed relation of the sealing walls 20, 28, 40 and 42 and thereby permits the sealed relationship of the lid with the top wall to be maintained at even greater pressure differentials than is normally expected. Further, if the lid begins its unseating movement circular outer rolled rim 36 of the lid can come into contact with the circular bottom or internal lid restraint surface 56 of the retainer ring body 52, thereby enhancing the force resisting characteristics of the retainer ring. At this point, the retainer ring will have force restraining contact with the retainer flange 70 and with the circular bottom surface 56 at a point before the sealed relationship of the metal to metal sealing walls is lost. The central panel 34 can be bulged outwardly as shown in FIG. 3 and yet the sealed integrity of the lid with the container will be effectively maintained.

Since the central panels of most container lids are of fairly consistent size and configuration the lid retainer ring of the present invention, because it establishes retaining engagement with the central lid panel and bridges the ridges and grooves of the outer peripheral portion of the container lids, is generic to a wide variety of differing container lid designs and configurations. This feature minimizes the variety of inventory that might otherwise be required by users.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A container assembly comprising:

(a) a double friction seal type container having a side wall and a top wall being secured to the side wall by an outer peripheral bead having a downwardly facing outer peripheral shoulder, said top wall defining a circular friction seal channel having a U-shaped cross-section and defining an opening for said top wall of said container;

(b) a removable friction lid in pressure friction sealed relation with said top wall, said removable friction lid having a circular central lid panel having a center and having an outer U-shaped circular friction member in removable frictional sealing engagement with said U-shaped friction seal channel of said top wall of retainer body said container;

(c) a lid retainer ring having a circular defining inner and outer peripheries and having a sufficient radial width to extend from the outer peripheral bead of said container to a location radially inwardly of said circular lid seal and to overlay an intermediate portion of said central lid panel of said container lid between said circular lid seal and said center of said removable friction lid when said container lid is in seated frictional sealing assembly with said top wall of said container;

(d) a circular inner retainer flange extending downwardly from said inner periphery of said circular retainer body and having lid retaining engagement with said intermediate portion of said central lid panel of said removable friction lid at a location radially inwardly of said circular lid seal and between said circular lid seal and said center of said central lid panel and resisting container pressure induced bulging of said central lid panel and resisting container pressure induced unseating movement of said friction lid; and (e) an outer circular locking flange extending downwardly from said outer periphery of said circular retainer body and defining an upwardly facing locking shoulder having locking engagement with said downwardly facing outer peripheral shoulder of said outer peripheral bead of said container.

2. The container assembly of claim 1, wherein:

said circular retainer body, said circular retainer flange and outer circular locking flange are integral and are composed of a polymer material.

3. The container assembly of claim 1, wherein:

said outer circular locking flange is flexible and being yieldable radially outwardly by said outer peripheral bead of said container during assembly of said lid retainer ring to said container.

4. The container assembly of claim 1, wherein:

said outer circular locking flange is flexible and is yieldable radially outwardly by said outer peripheral bead of said container during assembly of said lid retainer ring to said container and further defining a downwardly and inwardly facing internal tapered surface for engagement with said outer peripheral bead of said container for guiding said outer locking flange past said outer peripheral bead as said lid retainer ring is assembled with said container, said outer locking flange moving into interlocking relation with said downwardly facing outer peripheral shoulder of said outer peripheral bead upon moving past said outer peripheral bead of said container during assembly of said lid retainer ring to said container.

5. The container assembly of claim 1, wherein:

said lid retainer ring is composed of a polymer material having sufficient flexibility to be yieldable by the pressure induced unseating force and having sufficient rigidity for retention of said removable friction lid in sealed assembly with said container up to a predetermined pressure differential.

6. A container assembly, comprising:

(a) a circular double friction seal type container having a side wall and top wall being secured in assembly by an outer peripheral bead defining a downwardly facing outer peripheral shoulder, said top wall having a circular rim defining an opening for the container and defining a circular friction seal groove about the opening, said circular friction seal groove having a U-shaped cross-section defining spaced circular concentric sealing surfaces;

(b) a removable friction lid having a circular friction sealing element for friction sealing engagement within the circular friction seal groove of said top wall of said container, said circular friction seal groove and circular friction seal element defining a pressure containing circular lid seal, said removable friction lid also defining a circular central panel having a center;

(c) lid retainer ring having a circular retainer body defining inner and outer peripheries and having a radial width sufficient to extend from said outer peripheral bead of said container radially inwardly beyond said circular lid seal and to overlay a circular intermediate region of said circular central panel of said friction lid located between said circular lid seal and said center of said circular central panel when said removable friction lid is seated in friction sealed assembly with said top wall of said container;

(d) a circular inner retainer flange depending from said inner periphery of said retainer body and having retaining engagement with said central panel of said friction lid at a location radially inwardly of said circular lid seal and intermediate said circular lid seal and said center of said central panel of said friction lid for resisting pressure induced upward movement of the central panel of the friction lid responsive to differential pressure of the container and the environment externally thereof; and (e) a circular outer locking flange depending from said outer periphery of said retainer body and defining an upwardly facing circular locking shoulder for locking engagement with said downwardly facing outer peripheral shoulder of said outer peripheral bead of said container.

7. The container assembly of claim 6, wherein:

said circular retainer body, circular inner retainer flange and circular outer locking flange is of integral construction and is composed of a polymer material.

8. The container assembly of claim 6, wherein:

said circular outer locking flange are flexible and are yieldable radially outwardly by the peripheral bead of the container during assembly of said lid retainer ring to said container.

9. The container assembly of claim 6, wherein:

said outer locking flange are flexible and are yieldable radially outwardly by said outer peripheral bead of said container during assembly of said lid retainer ring to said container and further defining a downwardly and inwardly facing internal tapered surface for engagement with said outer peripheral bead of said container for guiding said outer locking flange past said outer peripheral bead as said lid retainer ring is assembled with said container.

10. The container assembly of claim 6, wherein:

said lid retainer ring is composed of a polymer material having sufficient flexibility that said lid retainer ring is yieldable by container pressure unseating force acting on said lid of said container responsive to said pressure differential and retaining said container lid in friction seated and sealed assembly with said container up to a predetermined pressure differential.

11. A container assembly comprising:

(a) a double friction seal type metal container having a side wall and a top wall being interconnected by a circular bead defining a downwardly facing outer peripheral circular shoulder, said top wall having spaced circular concentric friction sealing surfaces and a rolled radially inner rim defining a circular opening;

(b) a removable circular closure lid having friction sealing engagement with said top wall and having spaced circular concentric friction sealing surfaces in friction sealing engagement with said spaced circular concentric friction sealing surfaces of said top wall, said circular closure lid defining a circular lid seal and defining a circular lid panel located radially inwardly of said circular lid seal and having a center;

(c) a circular lid retainer ring having a retainer body section defining radially inner and outer peripheries and being of sufficient radial width for said outer periphery to overlay said outer periphery of said container and for said inner periphery to extend radially inwardly beyond said circular friction sealing surfaces of said container and lid and radially inwardly of said circular lid seal and having retaining engagement with an intermediate circular portion of said central lid panel located between said circular lid seal and said center of said circular lid panel;

(d) a circular locking flange being integral with said circular body section and depending from said outer periphery of said circular body section, said circular locking flange defining a radially inwardly extending circular locking projection having an upwardly facing locking shoulder being in locking engagement with said downwardly facing outer peripheral circular shoulder of said circular bead of said container, said circular locking flange having sufficient flexibility to yield radially outwardly and pass over said circular bead and snap into locking engagement with said downwardly facing outer peripheral shoulder during assembly of said circular lid retainer ring with said container; and (e) a circular retainer flange being integral with said circular retainer body section and depending from said inner periphery of said circular body section and having retaining engagement with an intermediate circular region of said central lid panel at a location radially inwardly of the circular lid seal and between said circular lid seal and said center of said circular lid panel and restraining container pressure induced bulging of said central lid panel and resisting unseating of said removable circular closure lid by internal container pressure.

12. The container assembly of claim 11, wherein:

said locking projection defining a tapered circular guide surface facing downwardly and radially inwardly and disposed for guiding engagement with said circular bead of said container during assembly of said circular lid retainer ring with said double friction seal type metal container.

13. The container assembly of claim 11, wherein:

(a) said circular retainer body section defining radially inner and outer substantially concentric circular peripheries; and (b) said locking flange and said retainer flange projecting downwardly from respective outer and inner circular peripheries of said circular body section and being disposed in substantially concentric relation and being sufficiently radially spaced for said circular retainer flange to engage said intermediate circular region of said central panel of the removable closure lid.

14. The container assembly of claim 11, wherein:

said circular body section defines a circular internal lid restraint surface located between said circular locking flange and said circular retainer flange, upon predetermined unseating of said circular closure lid from its fully seated relation with said top wall of said container said outer periphery of the closure lid being restrained by said lid restraint surface at a location radially outwardly of said circular restraining contact of said retainer flange with said central lid panel of said circular closure lid.

* * * * *